US005993602A

United States Patent [19]

Smith et al.

[11] Patent Number: 5,993,602

[45] Date of Patent: Nov. 30, 1999

[54] METHOD OF APPLYING PERMANENT WET STRENGTH AGENTS TO IMPART TEMPORARY WET STRENGTH IN ABSORBENT TISSUE STRUCTURES

[75] Inventors: Michael John Smith; James Martin Kaun, both of Neenah, Wis.; Victor Robert Gentile, Brookhaven, Pa.

[73] Assignee: Kimberly-Clark Worldwide, Inc., Neenah, Wis.

[21] Appl. No.: 08/897,326

[22] Filed: Jul. 21, 1997

[51] Int. Cl.[6] ..... B31F 1/12

[52] U.S. Cl. ..... 162/112; 162/190; 162/183; 162/164.1; 162/164.3; 162/164.6; 162/158

[58] Field of Search ..... 162/109, 111, 162/112, 113, 158, 164.1, 190, 183, 184, 169, 164.3, 164.6; 264/282, 283; 156/183

[56] References Cited

U.S. PATENT DOCUMENTS 2,996,424 8/1961 Voigtman et al. ..... 162/112
3,014,832 12/1961 Donnelly ..... 162/111
5,695,607 12/1997 Oriaran et al. ..... 162/112

FOREIGN PATENT DOCUMENTS

13167/92 10/1992 Australia .

OTHER PUBLICATIONS

Au et al., "Applications of wet–end paper chemistry," First edition, Blackie Academic & proffesional, pp. 116–117, Jan. 1995.

*Primary Examiner*—Stanley S. Silverman
*Assistant Examiner*—Jose A. Fortuna
*Attorney, Agent, or Firm*—Judy Garot

[57] ABSTRACT

Permanent wet strength agents are applied to the surface of the Yankee dryer along with the creping adhesive formulation and thereafter transferred to the tissue web as the tissue web is being adhered to the Yankee. When a sufficient amount of permanent wet strength agent is applied, improved temporary wet strength is attained.

9 Claims, 4 Drawing Sheets

METHOD OF APPLYING PERMANENT WET STRENGTH AGENTS TO IMPART TEMPORARY WET STRENGTH IN ABSORBENT TISSUE STRUCTURES

BACKGROUND OF THE INVENTION

The use of softening and strengthening agents in the manufacture of tissues, such as facial and bath tissue, is common practice in the industry. These tissues typically contain a blend of relatively long fibers, which are usually softwood fibers, and relatively short fibers, which are usually hardwood fibers. The softening and strengthening agents may be separately added to these different fiber species prior to or after blending the fibers together and forming the tissue web. Preferably, the softening agent is added to the short fibers since the short fibers primarily contribute to tissue softness. The long fibers are separately treated with strengthening agents (wet and dry) and refining. Both refining and strengthening agents are used because excessive use of either treatment may have an adverse effect on the tissue making process and/or the resulting tissue product. In particular, temporary wet strength resins are often added to tissue products to impart integrity to the tissue when wet. For bath tissue, sufficient wet strength is required to minimize "feathering" after flushing and maintain integrity during use. Feathering, which is the phenomena of retaining residual fragments of tissue left in the toilet bowl after flushing, is perceived as undesirable by consumers from both an aesthetic and strength viewpoint. However, the wet strength resin also needs to be temporary, meaning it disintegrates over time in the presence of water to prevent plugging of sewer systems and septic tanks.

However, the conventional method of adding temporary wet strength agents to the fiber furnish has some disadvantages. This adds additional expense (chemical delivery system, material cost) and requires constant monitoring to maintain wet tensile specification. Also, temporary wet strength resins invariably have a relatively short shelf life due to their propensity to cross-link and subsequently gelling making it difficult to handle in a mill environment. Variations in temperature and humidity can exacerbate this phenomena.

Therefore there is a need for a more efficient method of utilizing temporary wet strengthening agents in the manufacture of tissues.

SUMMARY OF THE INVENTION

It has now been discovered that a soft and strong creped tissue can be produced by the indirect addition of permanent wet strength agents to the tissue web by applying the permanent wet strength agents to the surface of the Yankee dryer, such as by spraying. More specifically, the permanent wet strength agents can be included as part of the creping adhesive formulation, which is sprayed onto the surface of the Yankee dryer between the creping blade and the pressure roll. The permanent wet strength agents are subsequently transferred to the tissue sheet surface as the sheet is pressed against the Yankee dryer.

Permanent wet strength agents need a sufficient amount of time to cross-link with the fibers and fully develop its strength potential. Although a portion of the permanent wet strength agent transfers to the surface of the tissue sheet in the pressure roll nip, in the short period of time which elapses between addition of the wet strength agent to the tissue sheet and subsequent creping, the amount of permanent wet strength imparted to the sheet is relatively small.

Nevertheless, a portion of the permanent wet strength agent passes through the tissue sheet and becomes recycled to the wet end of the tissue machine with the white water. This material preferentially attaches itself to the fines in the white water and becomes part of the newly-formed tissue web when those fines are trapped within the web during formation. Unexpectedly, the net result is that the permanent wet strength agent added at the Yankee imparts temporary wet strength to the creped tissue web. The resulting tissue exhibits greater dissociation in water than would be attained using smaller than normal amounts of a permanent wet strength agent in the wet end. While not being bound to any theory, it is believed that attaching the permanent wet strength agent preferentially to the fines in the white water plays a role in creating a tissue structure that breaks up more easily than structures in which the permanent wet strength agent is predominantly attached to whole fibers. Temporary wet strength with more uniform dispersability is highly desirable for tissue products such as bath tissue or any other flushable product form. In addition, there is a cost savings in that commercially available permanent wet strength agents are generally less expensive than temporary wet strength agents. Hence the method of this invention provides adequate temporary wet strength and improved break-up properties at a lower chemical cost.

Hence in one aspect the invention resides in a method for making creped tissue comprising: (a) forming a wet tissue web by depositing an aqueous papermaking furnish onto a forming fabric; (b) partially dewatering the tissue web; (c) applying a creping adhesive and one or more permanent wet strength agents to the surface of a Yankee dryer; (d) adhering the tissue web to the surface of the Yankee dryer with a pressure roll such that water is removed from the web and recycled to the aqueous papermaking furnish of step (a), wherein the permanent wet strength agent is carried with the water back to the forming step (a); and (e) creping the web, wherein the permanent wet strength agent imparts temporary wet strength to the creped web.

In another aspect, the invention resides in a tissue product made by the above-mentioned method.

Suitable permanent wet strength agents include, without limitation, polyamine/amide epichlorohydrins, epoxides, polyethyleneimines, and latexes.

The amount of permanent wet strength agent added to the Yankee dryer can be any amount that is effective in increasing the wet integrity of the resulting tissue and will depend on the particular agent selected and the desired strength effect. Nevertheless, suitable amounts of permanent wet strength agent, expressed as the weight percent solids based on the dry weight of fiber, can be from 0.12 to about 1 weight percent, more specifically from about 0.15 to about 0.5 weight percent, and still more specifically from about 0.15 to about 0.2 weight percent.

The addition of a permanent wet strength agent in accordance with the method of this invention imparts a temporary wet strength to the resulting tissue characterized by a cross-machine direction (CD) wet tensile strength of about 50 grams or greater per 3 inches of sample width. At the same time, the wet strength is temporary in that tissues made in accordance with this invention have a "photo grade" of 3 or less, more preferably 2 or less, and most preferably 1 or less, as measured by the water breakup test described below.

Specimens for CD wet tensile testing are prepared by using a double-edged cutter. If the tissue sample is a two-ply product, three sheets are cut to yield a total of six plies. The length of the sample strips are approximately six inches. The resulting six-ply test sample is artificially aged in an oven at 105° C. for 6 minutes and then conditioned in a standard atmosphere (23° F. and 50% relative humidity) for four hours. The sample strip is bent by holding it between the forefinger and thumb and dipped into distilled water, allowing the water to wick up the tissue approximately inch on each side. The strip is promptly placed in the jaws of an Instron Tensile Tester (Model No. 1122) with a slight amount of slack. The gauge length is four inches and the crosshead speed is 10 inches per minute with a 10 pound full scale load. After each sample test, the tensile reading at failure, divided by the number of sheets, is the CD wet tensile strength of the tissue sample per two-ply sheet. About ten tensile tests should be run for each tissue sample to provide a meaningful statistical average value for the particular tissue tested. If the sample is a one-ply product, three one-ply sheets are cut and subsequently tested.

The temporary nature of the temporary CD wet tensile strength is measured by the water break-up test, which simulates the turbulence typically observed in a toilet bowl while flushing. The tissue sample to be tested is cut into one or more squares measuring 4×4 inches to provide a two-ply test sample (one-ply for single-ply product forms). The sample is oven-cured for 4 minutes at 105° C. To run the test, the flow from a water faucet is adjusted to a rate of 2000±50 milliliters per 10 seconds. The water temperature is maintained between 21° C. and 26.5° C. The test sample is placed near the bottom of a 16-ounce, wide-mouth pint jar. A cover with a 4×4 mesh screen (McMaster-Carr, Inc.) is screwed over the jar. The screened opening of the jar is centered under the stream of water at a distance of 15±0.125 inches from the faucet outlet for a total of 2 minutes. The jar is rotated as needed to keep the screen from plugging with the tissue. After two minutes, the jar is pulled from the stream of water and the cover is removed, ignoring any debris sticking to the screen. The remains in the jar are allowed to settle and half of the contents (clear liquid only) are decanted off. The remaining contents are poured into another 16 oz wide mouth bottle (similar size) resting on a black surface. Viewed from the top, the jar with the test sample is compared to the six standard photographs (see FIGS. 2–7) and assigned a "photo grade" value relative to the six standards. The photo grade standards range in value from "0" (total breakup) to "5" (virtually no breakup).

DETAILED DESCRIPTION OF THE DRAWING

Figure 1:
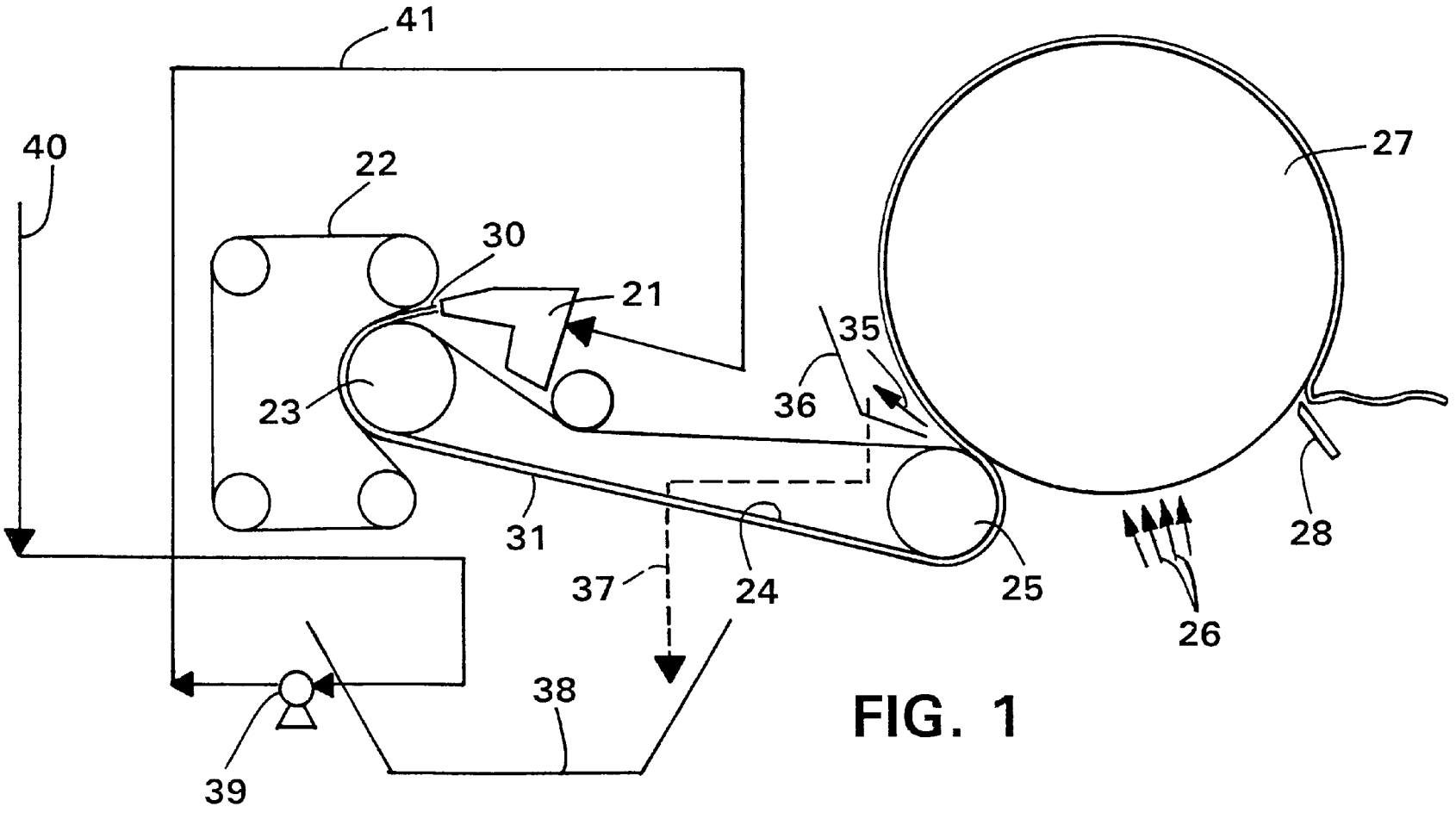
FIG. 1 is a schematic flow diagram of a wet-pressed tissue making process, illustrating the addition of either softening agents and/or permanent wet strength agents to the surface of the Yankee dryer. Also shown is the white water recycle flow.
Figure 2:
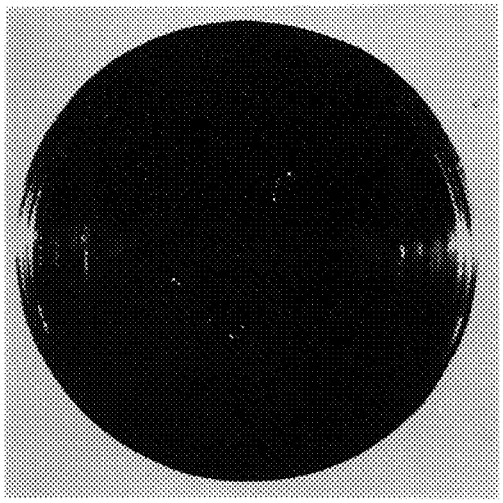
FIGS. 2–7 are photographs of tissue samples used as standards of comparison for evaluating tissue samples subjected to the water breakup test described above.
Figure 3:
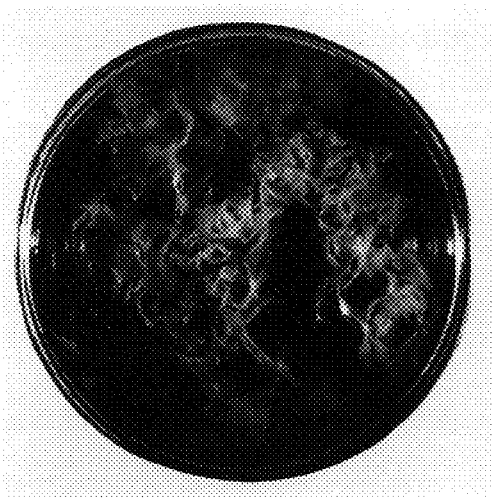
Figure 4:
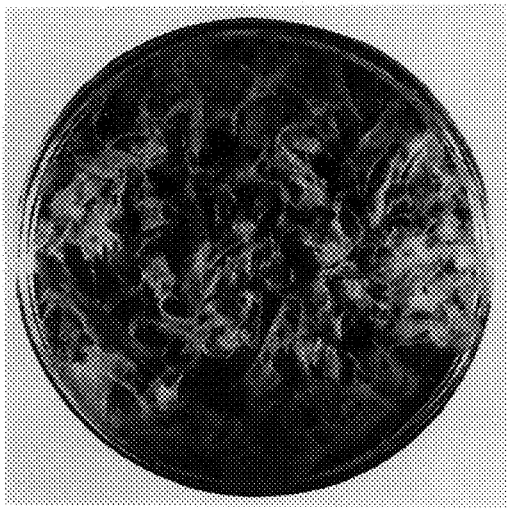
Figure 5:
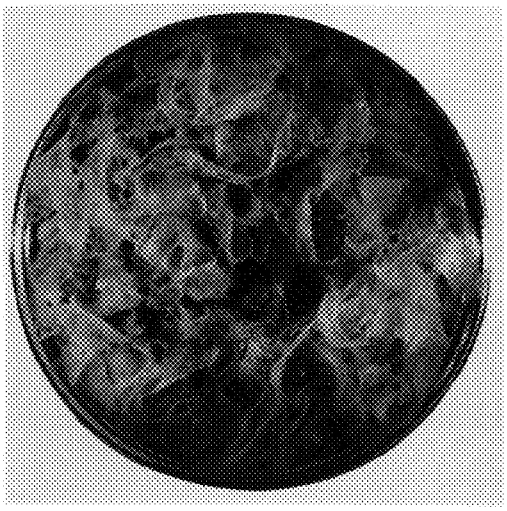
Figure 6:
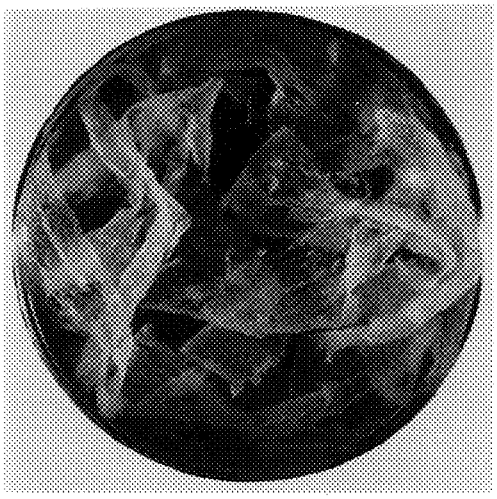
Figure 7:
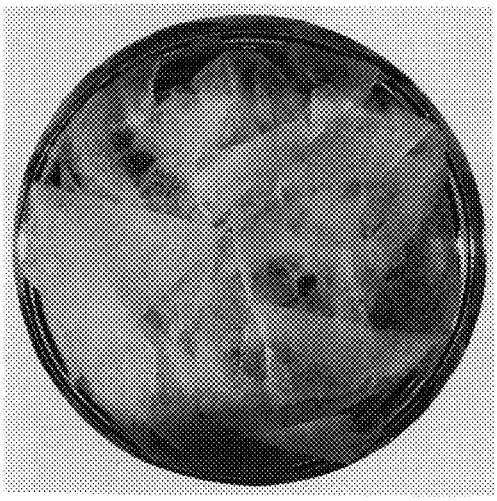

FIG. 1 is a schematic flow diagram of a conventional wet-pressed tissue making process useful in the practice of this invention, although other tissue making processes can also benefit from the stock prep method of this invention, such as throughdrying or other non-compressive tissue making processes. The specific formation mode illustrated in FIG. 1 is commonly referred to as a crescent former, although many other formers well known in the papermaking art can also be used. Shown is a headbox 21, a forming fabric 22, a forming roll 23, a paper making felt 24, a press roll 25, a spray boom 26, Yankee dryer 27, and a creping blade 28. Also shown, but not numbered, are various idler or tension rolls used for defining the fabric runs in the schematic diagram, which may differ in practice. As shown, the headbox 21 continuously deposits a stock jet 30 between the forming fabric 22 and felt 24, which is partially wrapped around the forming roll 23. Water is removed from the aqueous stock suspension through the forming fabric by centrifugal force as the newly-formed web traverses the arc of the forming roll. As the forming fabric and felt separate, the wet web 31 stays with the felt and is transported to the Yankee dryer 27.

At the Yankee dryer, the creping chemicals are continuously applied in the form of an aqueous solution to the surface of the Yankee dryer on top of the residual adhesive remaining after creping. In accordance with this invention, the creping chemicals can include one or more softening agents and/or one or more permanent wet strength agents. The solution is applied by any conventional means, preferably using a spray boom 26 which evenly sprays the surface of the dryer with the creping adhesive solution. The point of application on the surface of the dryer is immediately following the creping doctor blade 28, permitting sufficient time for the spreading and drying of the film of fresh adhesive before contacting the web in the press roll nip.

The wet web 31 is applied to the surface of the dryer by means of the press roll 25 with an application force typically of about 200 pounds per square inch (psi). The incoming web is nominally at about 10% consistency (range from about 8 to about 20%) at the time it reaches the press roll. Following the pressing and dewatering step, the consistency of the web is at or above about 30%. Sufficient Yankee dryer steam power and hood drying capability are applied to this web to reach a final moisture content of about 2.5% or less.

Also illustrated in FIG. 1 is the white water recycle system. At the press roll nip, white water effluent 35 expressed from the wet web is collected in catch pan 36. The collected white water 37 drains into wire pit 38. Thick stock 40 having a consistency of about 2-percent is diluted with white water at the fan pump 39 to a consistency of about 0.1 percent. The diluted stock 41 is subsequently injected into the headbox 21 to form the wet web.

EXAMPLES

Example 1

A soft, strong, absorbent tissue product was made in accordance with this invention using the overall process of FIG. 1. More specifically, a papermaking furnish was prepared consisting of 35% northern softwood kraft (NSWK) and 65% Eucalyptus fibers. Each fiber type was pulped separately and subsequently blended together. An amphoteric starch dry strength agent (Redi-Bond 2038, commercially available from National Starch and Chemical Company) and a wet strength agent (Kymene 557LX, commercially available from Hercules, Inc.) were sequentially added to the blended furnish. The Kymene 557LX was added as a 1 percent aqueous mixture. The addition rate was 0.16 weight percent based on dry fiber. The Redi-Bond 2038 was also added as a 1 percent aqueous mixture and the addition rate was 0.16 weight percent based on dry fiber. The resulting furnish was diluted to a consistency of about 0.6 dry weight percent.

The blended furnish was then further diluted to about 0.1 weight percent based on dry fiber, fed to a headbox and deposited from the headbox onto a multi-layer polyester forming fabric to form the tissue web. The web was then transferred from the forming fabric to a conventional wet-pressed carrier felt. The water content of the sheet on the felt just prior to transfer to the Yankee dryer was about 88 percent. The sheet was transferred to the Yankee dryer with a vacuum pressure roll. Nip pressure was about 230 pounds per square inch. Sheet moisture after the pressure roll was about 45 percent. The adhesive mixture sprayed onto the Yankee surface just before the pressure roll consisted of 40% polyvinyl alcohol, 40 percent polyamide resin (KymeneLX) and 20 percent imidazoline softening agent (methyl-1-oleyl amidoethyl-2-olyel imidazolinium methylsulfate, identified as C-6001, commercially available from Witco Corporation). The spray application rate was about 5.5 pounds of dry adhesive per ton of dry fiber (0.055 weight percent softening agent, based on dry fiber weight). A natural gas heated hood partially enclosing the Yankee had a supply air temperature of 533 degrees Fahrenheit to assist in drying. Sheet moisture after the creping blade was about 1.5 percent. Machine speed was 4000 feet per minute. The crepe ratio was 1.27, or 27 percent. The resulting tissue was plied together and lightly calendered with two steel rolls at 10 pounds per lineal inch. The two-ply product had the dryer side plied to the outside. When converted, the finished basis weight of the two-ply bath tissue at TAPPI standard temperature and humidity was 22.0 pounds per 2880 square feet. The CD wet tensile strength was about 135 grams per 3 inches. The water breakup photo grade was 5.

Example 2

A tissue was made as described in Example 1, but without Kymene 557LX added at the wet-end (thick stock prior to forming) and with the C-6001 softening agent replaced with Quaker 2008 in the creping adhesive formulation. The amount of permanent wet strength resin (Kymene 557LX) added to the surface of the Yankee dryer was 0.110 weight percent (based on dry fiber). The CD wet tensile strength was only approximately 35 grams per 3 inch wide strip with a photo-grade of less than or equal to 1. This example illustrates that the high CD wet tensile strength of Example 1 was due to the addition of the permanent wet strength agent (Kymene 557LX) in the wet end of the tissue machine, and not to the use of the Kymene as a normal component (40%) of the creping adhesive.

Example 3

A soft, strong, absorbent bath tissue product having temporary wet strength was made in accordance with this invention using the overall process of FIG. 1. More specifically, a papermaking furnish consisting of 40% NSWK and 60% Eucalyptus were pulped separately. An amphoteric starch dry strength agent (Redi-Bond 2038, commercially available from National Starch and Chemical Company) was added to the softwood fiber. Unlike Example 1, a layered headbox was used to layer the newly formed web such that the eucalyptus fiber furnish was laid down closest to the forming fabric and the softwood fibers were formed on top of the eucalyptus fibers. The layered web was then processed in a similar fashion as in Example 1, except that a permanent wet strength agent was added to the creping adhesive formulation instead of a softening agent. The creping formulation consisted of 34% polyvinyl alcohol, 62% polyamide permanent wet strength resin (Kymene 557LX) and 4% Quaker 2008 on a dry weight percent basis. The spray application rate of the creping adhesive was 6 dry pounds solids per ton of dry fiber. The amount of permanent wet strength resin added to the surface of the Yankee, based on dry weight of fiber, was 0.186 weight percent. The CD wet tensile strength of the resulting tissue was at least 50 grams per 3 inches and the water breakup photo grade was 3 or less, indicating acceptable temporary wet strength. The higher level of permanent wet strength in the creping adhesive formulation relative to that of Example 2 surprisingly provided adequate and steady temporary wet strength to the resulting bath tissue. Hence a separate chemical addition system to control temporary wet strength was not needed.

It will be appreciated that the foregoing examples, given for purposes of illustration, are not to be construed as limiting the scope of this invention, which is defined by the following claims and all equivalents thereto.

We claim:

1. A method for making creped tissue comprising:

(a) forming a wet tissue web by depositing an aqueous papermaking furnish onto a forming fabric;

(b) partially dewatering the tissue web;

(c) applying a creping adhesive and from 0.12 to about 1 weight percent, based on the dry weight of fiber in the tissue web, of one or more cationic permanent wet strength agents to the surface of a Yankee dryer;

(d) adhering the tissue web to the surface of the Yankee dryer with a pressure roll such that water and fines are removed from the web and recycled to the aqueous papermaking furnish of step (a), wherein the permanent wet strength agent is carried with the fines and the water back to the forming step (a); and (e) creping the web, wherein the permanent wet strength agent imparts temporary wet strength to the creped web.

2. The method of claim 1 wherein the amount of permanent wet strength agent is from about 0.15 to about 0.5 weight percent.

3. The method of claim 1 wherein the amount of permanent wet strength agent is from about 0.15 to about 0.2 weight percent.

4. The method of claim 1 wherein the water break-up photo grade of the creped tissue is about 3 or less.

5. The method of claim 1 wherein the permanent wet strength agent is a polyamine/amide epichlorohydrin.

6. The method of claim 1 wherein the permanent wet strength agent is an epoxide.

7. The method of claim 1 wherein the permanent wet strength agent is a polyethyleneimine.

8. The method of claim 1 wherein the permanent wet strength agent is a latex.

9. The method of claim 1 wherein the creping adhesive comprises polyvinyl alcohol.

* * * * *